US009527705B2

(12) United States Patent
Arzouman

(10) Patent No.: US 9,527,705 B2
(45) Date of Patent: Dec. 27, 2016

(54) LOCKING LIFT ARMS SAFETY MECHANISM FOR A LIFTING DEVICE-POWER UNIT

(71) Applicant: Harry H. Arzouman, Corona del Mar, CA (US)

(72) Inventor: Harry H. Arzouman, Corona del Mar, CA (US)

(73) Assignee: Salvatore Cala, Pebble Beach, CA (US)

( * ) Notice: Subject to any disclaimer, the term of this patent is extended or adjusted under 35 U.S.C. 154(b) by 79 days.

(21) Appl. No.: 14/121,790

(22) Filed: Oct. 17, 2014

(65) Prior Publication Data

US 2016/0107868 A1 Apr. 21, 2016

(51) Int. Cl.

| | |
|---|---|
| ***B66F 5/04*** | (2006.01) |
| ***B66F 1/02*** | (2006.01) |
| ***B66F 3/30*** | (2006.01) |

(52) U.S. Cl.

CPC ..... *B66F 5/04* (2013.01); *B66F 1/025* (2013.01); *B66F 3/30* (2013.01)

(58) Field of Classification Search

CPC ..... B66F 1/06; B66F 1/04; B66F 1/025; B66F 1/00; B66F 17/00; B66F 3/30

See application file for complete search history.

(56) References Cited

U.S. PATENT DOCUMENTS

| | | | | |
|---|---|---|---|---|
| 3,758,076 | A * | 9/1973 | Tranchero | B66F 5/04 254/8 R |
| 4,289,299 | A * | 9/1981 | Kameda | B66F 5/04 254/8 B |
| 4,635,902 | A * | 1/1987 | Chou | B66F 5/04 254/8 B |
| 5,618,029 | A * | 4/1997 | Chung | B66F 5/04 254/8 B |
| 5,878,996 | A * | 3/1999 | Loan | B66F 5/04 254/8 B |
| 7,108,245 | B2 * | 9/2006 | Lin | B66F 5/04 254/8 B |
| 7,413,169 | B2 * | 8/2008 | Arzouman | B66F 5/04 254/134 |

(Continued)

*Primary Examiner* — Joseph J Hail
*Assistant Examiner* — Tyrone V Hall, Jr.

(57) ABSTRACT

A power unit includes a frame having a handle with a control knob, and a pair of pivotal lift arms elevated by pushing the rearward ends by a push bar of a hydraulic cylinder. The cylinder has a control valve attached to a control shaft extending from the control knob. A pair of guide rail are attached to the bottom of the frame; and a pair of rack bars are slidably mounted on each guide rail, and has a forward end pivotally linked to the push bar. A pair of dogs are positioned above the rack bar, each having a rearward end pivotally attached to the frame and a forward end engaging a tooth of the rack bar. The forward end of each dog engages the rack bar as the lift arms are elevated; and in the event of a hydraulic failure, the dogs lock the lift arms in the elevated position. A release includes a cam tube having a V slotted opening in the underside thereof. A swing plate has a cam follower stud slidably engaged within the V slotted opening. The swing plate includes linkage that is actuated by rotation of the control knob. An initial rotation of the control knob automatically rotates the cam tube to release the dogs, and further rotation opens the valve to lower the lift arms.

9 Claims, 5 Drawing Sheets

(56) References Cited

U.S. PATENT DOCUMENTS

| | | | | |
|---|---|---|---|---|
| 7,434,782 | B2 * | 10/2008 | Arzouman | B66F 13/00 254/134 |
| 8,066,259 | B2 * | 11/2011 | Fang | B66F 5/04 254/2 B |
| 2003/0218159 | A1 * | 11/2003 | Arzouman | B66F 13/00 254/8 B |
| 2008/0111117 | A1 * | 5/2008 | Wu | B66F 5/04 254/8 R |
| 2008/0173852 | A1 * | 7/2008 | Woodbury | B66F 5/04 254/8 B |
| 2008/0290332 | A1 * | 11/2008 | Zetterlund | B66F 1/00 254/8 B |
| 2012/0223280 | A1 * | 9/2012 | Zhou | B66F 5/04 254/8 B |

* cited by examiner

10

LOCKING LIFT ARMS SAFETY MECHANISM FOR A LIFTING DEVICE-POWER UNIT

CROSS REFERENCE TO RELATED APPLICATIONS

This application is directed to a Locking Lift Arm Safety Mechanism for a Power Unit. The safety mechanism is also adaptable to a conventional hydraulic floor jack. An application has also been filed of even date directed to a Locking Lift Arm Safety Mechanism for a Hydraulic Floor Jack. The separate applications were filed to preclude delays related to elections of claims and divisional filings of the inventions, that would be required for multiple searches of separate prior art and separate examinations of the prior art related to the respective claims. The present inventor will produce a power unit having the safety mechanism and produce a separate hydraulic jack having the safety mechanism. The applications were filed on the same date by the same inventor and the respective claims are each directed to the specific invention.

BACKGROUND OF THE INVENTION

The invention relates to a system for lifting and supporting an object; particularly to a two part jacking system including a power unit that can be used to place and elevate a jack stand for lifting and supporting a corner of a vehicle. The two part system is inherently safer to use than a conventional floor jack to elevate a vehicle, and which then requires the user to crawl under the vehicle to place a conventional jack stand adjacent to the elevated floor jack to support the load. The inventor of the present invention is a pioneer of the two part jacking system and holds numerous patents related to this technology.

Briefly, the two part jacking system consists of a mobile hydraulic power unit having a flat front base and extendable lift arms; and a separate mechanical jack stand that can be secured within the front base of the power unit, and elevated by extending the lift arms of the power unit, and locked by an integral ratchet locking mechanism. An example of the two part jacking system describing the power unit is shown in U.S. Pat. No. 7,410,148 (see FIGS. 1 and 9); and an example of the jack stand is also shown and described (see FIGS. 2-8).

In use, the jack stand is engaged within (and can be disengaged from) the front base of the power unit, and is maneuvered into position under a vehicle, to place the stand in a desired location for lifting and supporting a corner of the vehicle. The power unit is then activated by pumping the handle, raising the lift arms, and the stand is thereby extended vertically to the desired height, automatically locked in position, thus lifting and supporting the vehicle on the stand. By operating the controls at the end of the handle, the power unit lift arms are lowered, and the power unit is disengaged from the stand and pulled away, leaving the stand in position supporting the vehicle. The power unit is then free to position and extend another stand for elevating another corner of the same or another vehicle.

To lower the vehicle and remove the stand, the power unit is maneuvered into position to re-engage with the stand. By operating the controls at the end of the handle, the power unit is re-engaged with the base of the stand, and the lift arms are elevated to the height of the extended jack stand. The controls can then be operated to disengage the ratchet locking mechanism of the stand, and the lift arms are released to lower the stand to its original position. The power unit remains engaged with the stand and can be pulled away from the vehicle with the stand carried within the base.

The early designs of the power unit were adapted to carry several stands within the base; current models carry only one stand. Additional stands could be acquired to reload the power unit, so that a single power unit could be utilized to efficiently place and actuate numerous stands. Many commercial users employed the system for multiple ongoing projects, and would utilize all of their available stands. The power unit was thereafter useless until another stand was available, from a completed project, to be extracted and reused on a new project The present inventor developed a "bridge" lifting plate positioned to bridge between the forward ends of the lift arms and adapts the power unit to function as a hydraulic floor jack, to more fully utilize the power unit. The present inventor also developed a bridge plate that could travel along the lift arms, and that was biased by springs toward the forward ends of the lift arms and onto the leveling pads to provide an "automatic slide forward bridge". The vertical housing of the jack stand would force the bridge rearward on the lift arms. When there were no more stands within the base of the power unit, (and when the lift arms were in the lowered position) the bridge would automatically slide forward onto the leveling pads at the forward ends of the lift arms. The power unit then functioned directly as a hydraulic floor jack.

The use of a slide forward bridge with the power unit acting as a floor jack must be utilized with a safety mechanism to lock the elevated lift arms in position, in the event of any decay of hydraulic pressure while elevated.

Such a safety mechanism was initially developed and described in U.S. Pat. No. 6,663,081. The mechanism included a pair of rack bars fixed to the bottom of the power unit and a pair of dogs translated with a push bar to engage the rack bars in the event of a hydraulic pressure failure. To lower the lift arms, the dogs were releasable with a set of cables and springs by a release lever prior to releasing the control valve of the hydraulic cylinder. This mechanism was functional, but did not provide the desired durability, and further required the operator to actuate the lever to release the dogs, and then the control knob to release the lift arms.

An improved safety mechanism was developed and described in U.S. Pat. No. 7,413,169 (see FIGS. 35-37). This mechanism involved a pair of rack bars fixed within a pair of U-channels that retained the ends of a push bar. The ends of the push bar each included an extendable dog to automatically engage the rack bars to lock the lift arms. The dogs were releasable, through cables and springs, by a release lever prior to release of the control valve of the cylinder. This design was functional, but still required the manual use of a control lever prior to release of the control valve. The cables and springs were not as durable as desired for the power unit.

It is an object of the present invention to provide a power unit having a safety mechanism that is reliable and durable for automatically locking the lift arms when they are raised, and which is automatically released with the control knob when the lift arms are lowered.

SUMMARY OF THE INVENTION

The foregoing object is accomplished by the power unit of the present invention. The power unit includes a rectangular frame having a forward end, a rearward end, a bottom, sides and a pair of longitudinal side flanges extending upward from the sides of the frame. The rearward end has a tubular control handle pivotally attached and extending from the frame with a rotatable control knob at the upper end of the handle.

A pivotal lifting system is mounted on the frame including a pair of parallel lift arms having rearward ends interconnected by a lateral push bar and having forward ends rotatable upward for lifting a load. A pair of longitudinal U-channel tracks are attached to the inner side flanges within the frame, and retain the ends of the lateral push bar. A hydraulic cylinder, actuated by pumping the control handle, has an extendable ram for pushing the lateral push bar forward along the tracks for raising the forward ends of the lift arms; and a releasable control valve for retracting the ram and the lateral push bar for lowering the forward ends of the lift arms.

The tubular handle encloses a control shaft extending from the control knob to the rearward end of the frame and includes a U-joint and coupling interconnecting the shaft to the control valve. The control knob is rotatable in the clockwise direction to close the control valve and is rotatable about 60°-90° in the counterclockwise direction to open the control valve.

The power unit further includes a rectangular "bridge" positioned on leveling pads and across the forward ends of the lift arms, whereby the power unit temporarily functions as a hydraulic floor jack The safety mechanism comprises a pair of parallel guide rails fixed to the bottom of the rearward end of the frame and extending longitudinally therefrom to a distance of about that of the fully extended push bar. A pair of slidable rack bars each having forward-ratcheting-teeth and a forward end pivotally linked to the push bar for traversing along the guide rails as the push bar is advanced and retracted.

A pair of dogs are positioned and extended above the rack bars, each having a rearward end pivotally attached to the frame, and having a forward end with a downward lug for engaging a respective tooth of the rack bar, as the rack bar is advanced with the push bar. Whereby, in the event of any loss of hydraulic pressure, the rack bar is locked from rearward movement by the dog.

The mechanism further includes means for disengaging the forward lugs of the dogs from the rack bars when there is sufficient hydraulic pressure, and it is desired to lower the lift arms.

The preferred disengaging means includes a lateral cam tube rotatably attached to the side flanges of the frame and positioned above the forward ends of the dogs. The cam tube has a pair of lever arms extending downwardly and forwardly near the forward ends of the dogs. A pair of lifting links pivotally interconnects the distal ends of the lever arms of the cam tube to the forward ends of the dogs. The disengaging means further includes means for rotating the cam tube to raise the lever arms to disengage the forward ends of the dogs from the rack bars.

The preferred cam tube rotating means includes the control shaft coupling having a swing arm extending forwardly therefrom, with a swing arm pin extending perpendicularly and downwardly from the distal end thereof. A forward pivot pin is attached to the frame and extends generally vertically at a position forward of the lateral cam tube and near the longitudinal center of the frame.

A swing plate is positioned horizontally and adjacently below the cam tube, and has a forward end pivotally attached to the forward pivot pin; and has a slotted rearward end pivotally and slideably engaged around the swing-arm pin. Whereby, as the control knob is rotated, the swing arm pin pivots the swing plate, and it traverses in a lateral arc along the underside of the cam tube.

The cam tube further has a generally V slotted opening in the cylindrical underside thereof; and the swing plate further has an upwardly extended cam follower stud positioned and slideably engaged within the V slotted opening. Whereby, as the control knob is rotated, the cam follower stud traverses within the V slotted opening to thereby rotate the cam tube to raise and lower the forward ends of the dogs to and from engagement with the rack bars, to respectively lock and un-lock the lift arms.

The V slotted opening in the cam tube preferably has a right side corresponding to the diameter and position of the cam follower stud when the control valve is in the fully closed position. The opening is then angled in a direction laterally inwardly (corresponding to the position of the stud with a rotation of the valve of about 30°) and longitudinally rearwardly (corresponding to a rotation of the cam tube sufficiently to elevate the forward ends of the dogs from engagement with the rack bars prior to any release of the valve) therefrom to an apex of the V slotted opening. Then, from the apex, generally in a lateral arc therefrom, whereby the cam tube retains the dogs in the elevated position while allowing the cam follower stud to traverse laterally as the knob is further rotated to release the valve, to the left side of the V slotted opening.

The safety mechanism automatically locks the lift arms when they are raised, and automatically un-locks the lift arms with the control knob, just prior to opening the control valve to lower the lift arms.

BRIEF DESCRIPTION OF THE DRAWINGS

While the novel features of the invention are set forth in the appended claims, the invention will be better understood along with other features thereof from the following detailed description taken in conjunction with the drawings, in which:

DETAILED DESCRIPTION OF THE INVENTION

Figure 1:
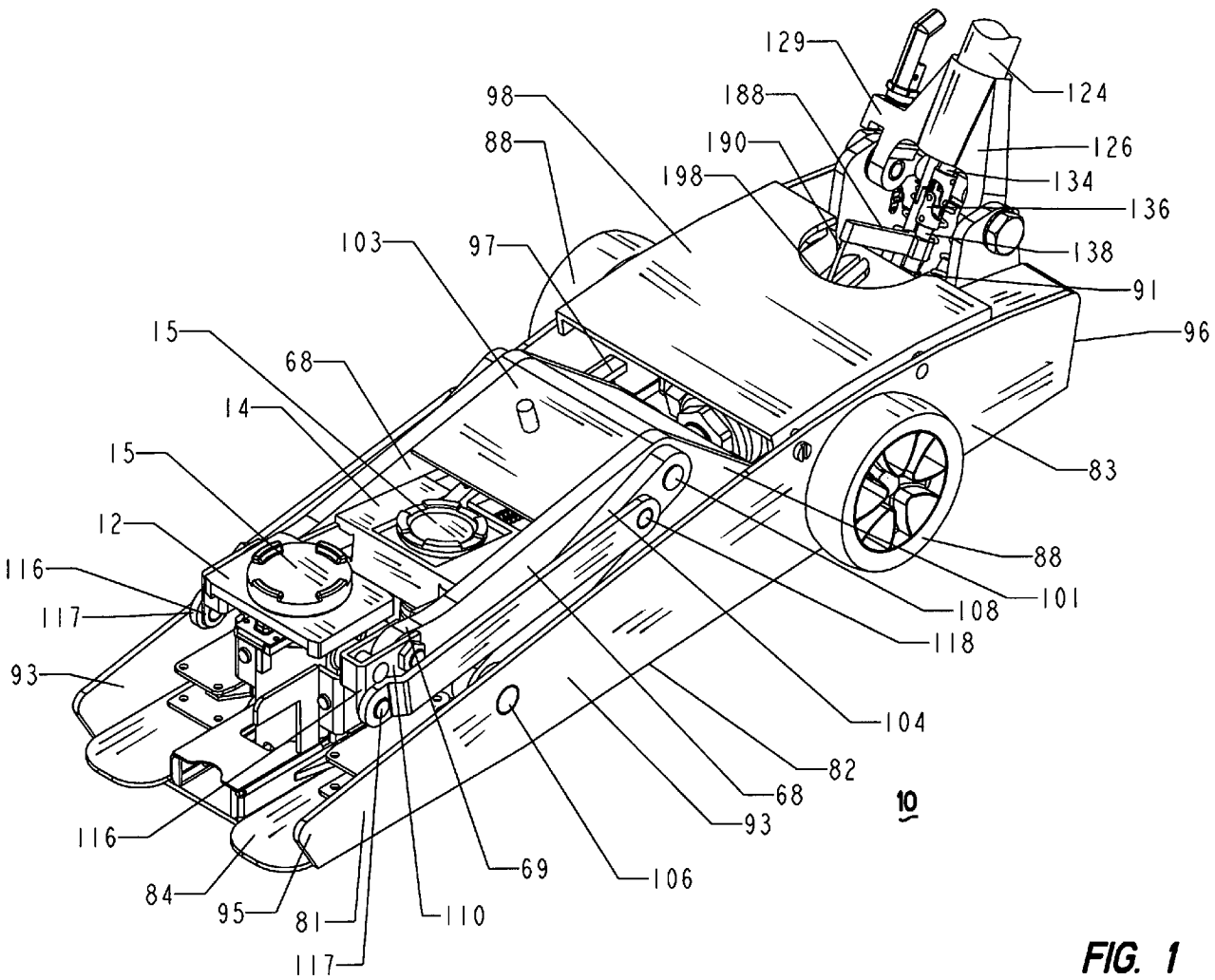
FIG. 1 is top-front perspective view of a power unit carrying a jack stand and having the locking lift arm safety mechanism of the present invention.
Figure 2:
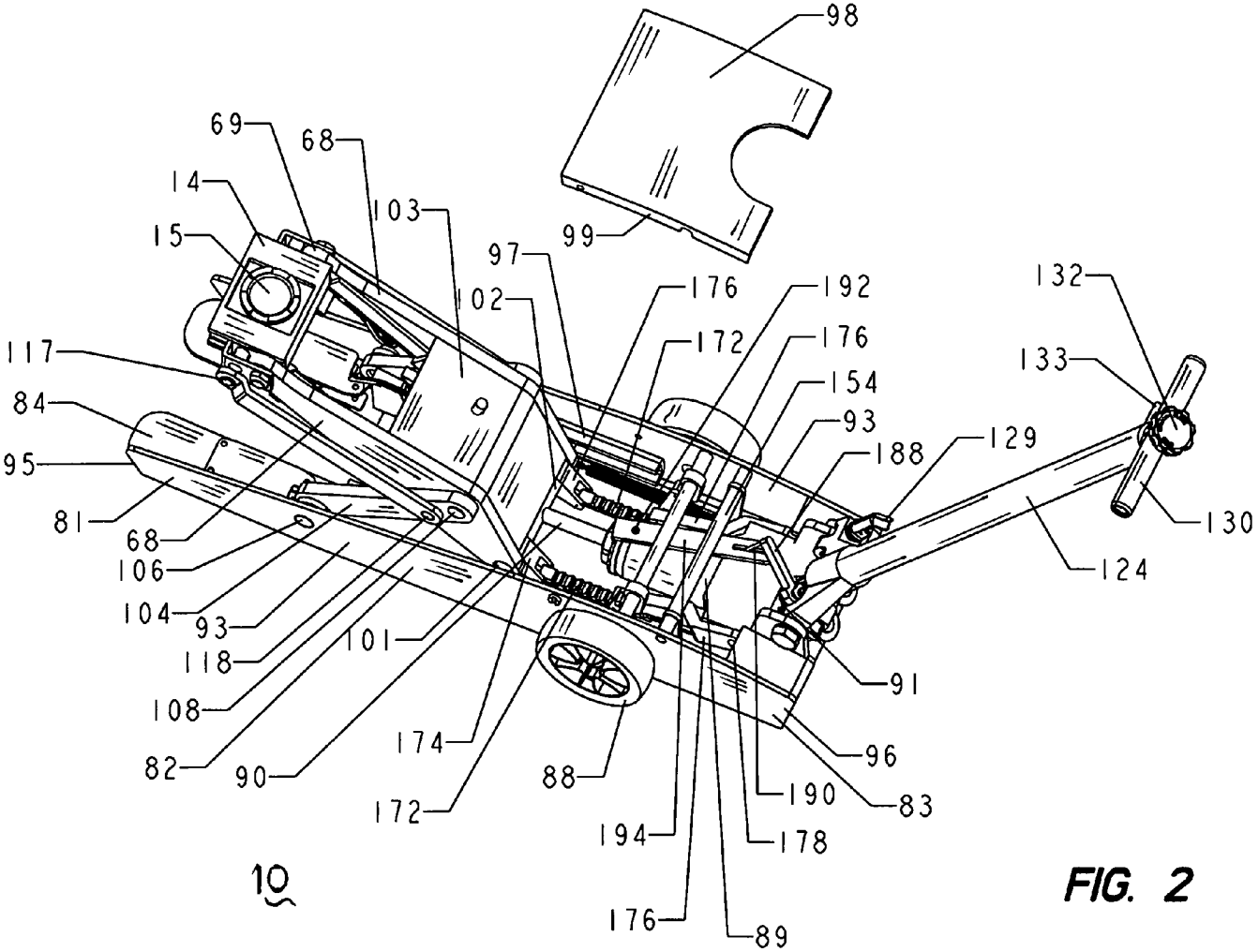
FIG. 2 is a top rear perspective view of the power unit acting as a floor jack, and in the elevated position, with the rear cover plate removed, showing the safety mechanism.

Referring first to FIG. 1, there is shown a power unit 10 of the present invention, for use with a jack stand 12 for lifting and supporting a load. Referring also to FIG. 2, the power unit is also readily convertible, by a slide forward bridge 14, for use directly as a hydraulic floor jack. The jack stand and the bridge each include a standard screw-out saddle 15 for adjusting the initial contact elevation of the power unit relative to the load. The power unit has a rectangular frame with a forward end 81 for loading and unloading the jack stand, a middle portion 82 for securing the lifting system, a rearward end 83 for controlling the power unit, and a bottom 84

The bottom 84 of the frame has the forward end 81 thereof substantially flat for providing a solid lifting platform, and has the middle portion 82 and rearward end 83 angled longitudinally upwardly for facilitating mobility of the power unit by a pair of wheels 88 located near the rearward end of the frame.

A hydraulic cylinder 89 having an extendable ram 90 at the forward end thereof, and having a rotatable control valve 91 at the rearward end thereof, is attached along the longitudinal center near the rearward end of the bottom of the frame.

The frame has a pair of longitudinal side flanges 93 extending upward from the bottom 84 thereof; and has the pair of wheels 88 attached to the outer sides of the flanges on lateral axles near the rearward end. Each side flange has a rounded vertical nose 95 at the forward end and a smooth generally vertical blunted tail 96 at the rearward end. Each side flange has a smooth arcuate upper contour extending upwardly from the rounded nose to about the height of the wheels and then downwardly mating with the blunted tail, providing an attractive appearance for the frame of the power unit. Each flange further includes a "U" shaped retaining channel 97 facing inwardly and attached horizontally along the inner side of the middle portion of the flange.

The power unit 10 includes the pair of lift arms 68 that act in parallel and have forward ends 69, middle portions 100 and rearward ends 101. The lift arms are interconnected at the rearward ends by a lateral push bar 102, with the respective ends of the push bar slidably retained (in suitable pivotal bushings) within the respective retaining channel 97 of the frame flanges 93; and the forward ends of the lift arms extend toward the forward end 81 of the frame.

The middle portion of the lift arms 68 include an upper cover plate 103 securely welded between the lift arms. The upper cover plate provides additional strength and stability to the lift arms, and protects some of the internal lifting components of the power unit 10.

A pair of connecting arms 104 act in parallel with the lift arms 68. The connecting arms have forward ends 106 and rearward ends 108, with the respective forward end pivotally connected (at 106) near the forward end of the respective flange 93 of the frame. The respective rearward end is pivotally connected (at 108) on the middle portion of the respective lift arm.

The hydraulic cylinder 89 has the ram 90 at the forward end attached to the center of the lateral push bar 102. When the ram is extended, the push bar and the rearward ends 101 of the lift arms 68 are translated forward along the retaining channels 97 in the flanges 93 of the frame. The forward ends 69 of the lift arms are thereby raised, in scissor-like fashion with the connecting arms 104.

The forward ends 69 of the lift arms 68 include a pair of leveling pads 110 that are pivotally attached thereto and act in parallel. The leveling pads support the upper lifting plate of the jack stand 12, and support the slide forward bridge 14 when it is positioned on the forward ends of the lift arms. Each of the leveling pads has a downwardly extended lever arm 116 at the forward end thereof for connecting to a leveling link. Each leveling link has a forward end 117 pivotally connected to the respective lever arm, and a rearward end pivotally connected to a point 118 on the respective connecting arm 104; so that as the forward ends 69 of the lift arms 68 are raised and lowered, the leveling pads are maintained in a substantially horizontal orientation.

The rearward end 83 of the frame includes a generally rectangular rear cover plate 98 having downwardly extended side flanges 99, and extends along and within the rearward portion of the contour of the side flanges 93 of the frame. The rear cover plate covers the hydraulic cylinder 89 and most of the safety mechanism. The rear cover plate provides some protection for the components and a clean appearance for the rear of the power unit 10.

The power unit 10 includes a tubular handle 124 at the rearward end of the frame having a T bar hand grip 130 with a rotatable control knob 132 at the proximal end, and a yoke 126 at the distal end pivotally attached to upper flanges of the rearward end of the frame. The handle is used for maneuvering the power unit about on its wheels 88, for pumping the handle to actuate the hydraulic cylinder 89, and for controlling the inter-engagement of the power unit with the jack stand 12.

The handle is controlled by a control mechanism 129 that enables the handle to be locked for maneuvering, free for pumping, and folded over for shipping and storing of the power unit.

The rotatable control knob 132 has a control shaft 134 (see FIGS. 2 and 4) extending from the control knob through the tubular handle 124 to the distal end thereof; and the distal end of the control shaft is attached to one end of a Universal joint 136. The U-joint is aligned at the same level as the axle of the pivotal tubular handle, so that the handle with the control shaft can be folded over for storing and shipping. The U-joint is attached to a coupling shaft 138, which is further connected to the control valve 91 at the rear of the cylinder 89.

The handle also includes a control rod connected at the proximal end to a control lever 133 extending from the handle near the T-bar hand grip, and having the distal end connected through another U-joint coupling (not shown) linked to a lateral torsion tube 154 pivotally attached to the frame (see FIG. 2) and further to a flipper system at the forward end 81 of the frame for controlling the jack stand. The control rod and torsion tube are not shown in detail, so that the components of the safety mechanism can be more clearly illustrated.

The power unit 10 may further include a pair of eyelets at the rearward end of the upper cover plate 103, and the rearward end of the frame (at the rearward sides of the hydraulic cylinder) include another pair of eyelets, for connecting a pair of strong tension springs (not shown). The springs ensure that the lift arms are lowered when the control valve is released and they are no longer forced downward by the load or their own weight. The springs are not shown so that the safety mechanism can be more clearly illustrated.

The bridge 14, when positioned onto the leveling pads at the forward ends of the lift arms, enables the power unit 10 to operate temporarily as a hydraulic floor jack. Conventional floor jacks have a history of accidents related to leaking seals and loss of hydraulic pressure that results in the untimely lowering of the lift arms and the elevated load. There has been a long felt need for a reliable durable locking lift arm safety mechanism for conventional floor jacks, and for a power unit acting as a floor jack, as described in the present invention.

The Safety Mechanism

Figure 3:
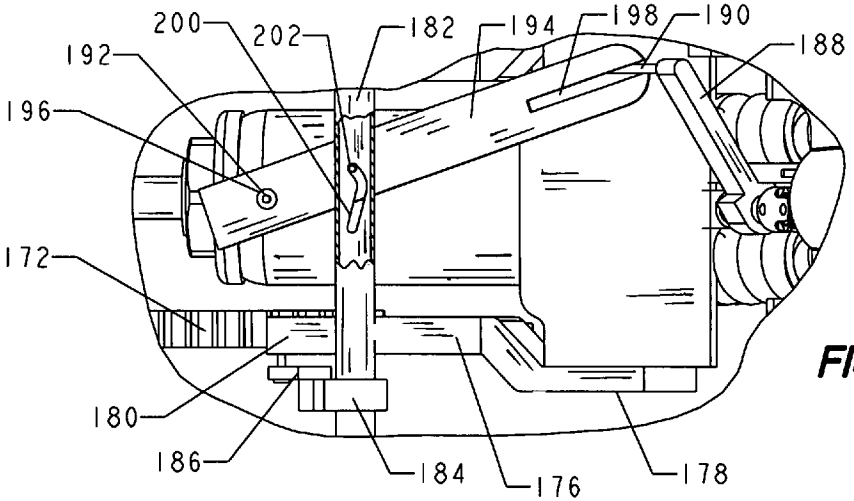
FIG. 3 is a partial top plan view of the safety mechanism, with the control valve in the closed position and the dogs engaged with the rack bar.
Figure 4:
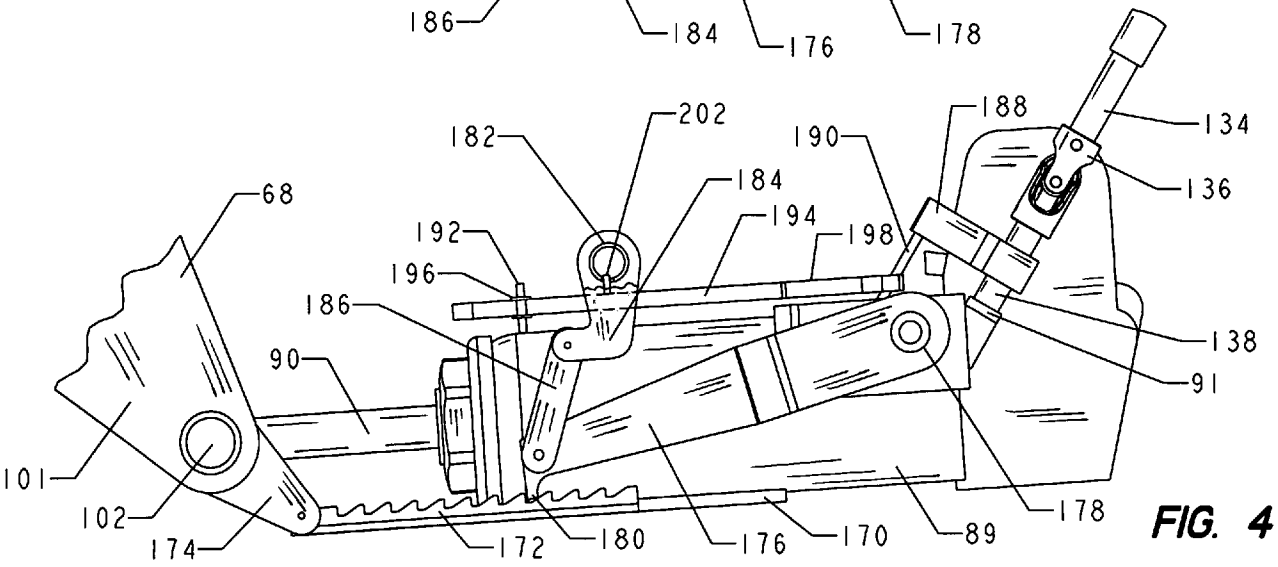
FIG. 4 is a left side elevational (partial sectional) view of the safety mechanism, as in FIG. 3, with the control valve in the closed position.

Referring also to FIGS. 3 and 4, a preferred embodiment of the safety mechanism includes a pair of parallel guide rails 170 fixed to the bottom of the rearward end 83 of the frame and extending longitudinally a distance of about that of the fully extended push bar 102. The guide rails are suitably rectangular steel stock, but can be other shapes, triangular or half-round etc.

The safety mechanism includes a pair of slidable rack bars 172, each having a forward end pivotally attached through a link 174 to the push bar 102, for traversing along the guide rails 170 as the push bar is advanced and retracted. Each rack bars has a set of forward ratcheting teeth on the upper surface. The underside of each rack bars includes a longitudinal recess for engaging the guide rail. The guide rails can alternatively be in the form of channels guiding the outer sides of the rack bars, and such channels are considered to be equivalent to the illustrated guide rails.

The safety mechanism includes a pair of dogs 176 positioned and extended above the rack bars 172. Each dog has a rearward end 178 pivotally attached to the frame, and has a forward end with a downward lug 180 for engaging a respective tooth of the rack bar, as the rack bar is advanced with the push bar 102. For sub-assembly purposes, the rearward ends of the dogs are pivotally attached to the upper rear sides of the hydraulic cylinder (that is attached to the frame). In the event of any loss of hydraulic pressure, the rack bars (and the push bar and lift arms) are locked from rearward movement by engagement of the forward ends of the dogs in the respective tooth of the rack bars.

With a loss of hydraulic pressure, slight rearward movement of the lift arms 68 wedge the forward ends 180 of the dogs firmly into engagement with the respective tooth of the rack bar 172. The control knob is locked, and the dogs can not be raised. If there is sufficient pressure for the push bar to be extended by pumping of the handle, the dogs (become un-wedged and) can be released and immediately thereafter, the power unit can be safely lowered. Otherwise, the load will remain elevated and it will require an additional jack to safely elevate and support the load while the defective power unit (acting as a hydraulic jack) is removed.

With a loss of hydraulic pressure and the components of the safety mechanism wedged as described above, the pivotal link 174, the rack bar 172 and the dog 176 are each under pure compressive stress loads (no tensile or torsion forces). Rigid steel components are extremely strong under compression loads, and the safety mechanism is clearly safe and durable to securely lock the lift arms in the elevated position.

The mechanism further includes means for automatically disengaging the forward end 180 of the dogs from the rack bars 172 by rotating the control knob 132, when there is sufficient hydraulic pressure, and it is desired to lower the lift arms 68.

One such disengaging means includes a pair of pulleys on a lateral axle with a set of cables extending from the forward ends of the dogs, over the pulleys and connected to the coupling shaft, and actuated by rotation of the control knob. This is an example of one of several cable arrangements that can be employed to automatically disengage the dogs from the rack bar.

Another disengaging means includes a rotary cam system on a vertical axle, actuated by the control knob, with the cam having a step for disengaging and retaining the dogs, for further rotation of the control knob to automatically release the control valve.

Another disengaging means includes a set of planetary gears actuated by the control knob with mating gears and linkage for raising and retaining the forward ends of the dogs by rotation of the control knob, then the control knob is further rotated to automatically release the control valve.

Referring also to FIGS. 5-8, the preferred disengaging means includes a lateral cam tube 182 rotatably attached to the side flanges 93 of the frame and positioned above the forward ends 180 of the dogs 176. The cam tube has a pair of lever arms 184 extending downwardly and near the forward ends of the dogs. A pair of lifting links 186 are pivotally interconnected to the distal ends of the lever arms 184 of the cam tube and to the forward ends of the dogs.

The lifting links 186 are designed to lift the forward ends 180 of the dogs 176, and not to force them downward to engage the rack bar 172. The forward ends of the dogs engage the rack bar by their own weight. The lifting link connections include slight clearances (slotted connections) and can even be in the form of flexible cables interconnecting the lever arms with the dogs. The lifting links allow the forward ends of the dogs to rise and fall as each tooth of the rack bar ratchets under the dogs, and when desired, become taut by rotation of the cam tube to elevate the dogs.

Figure 6:
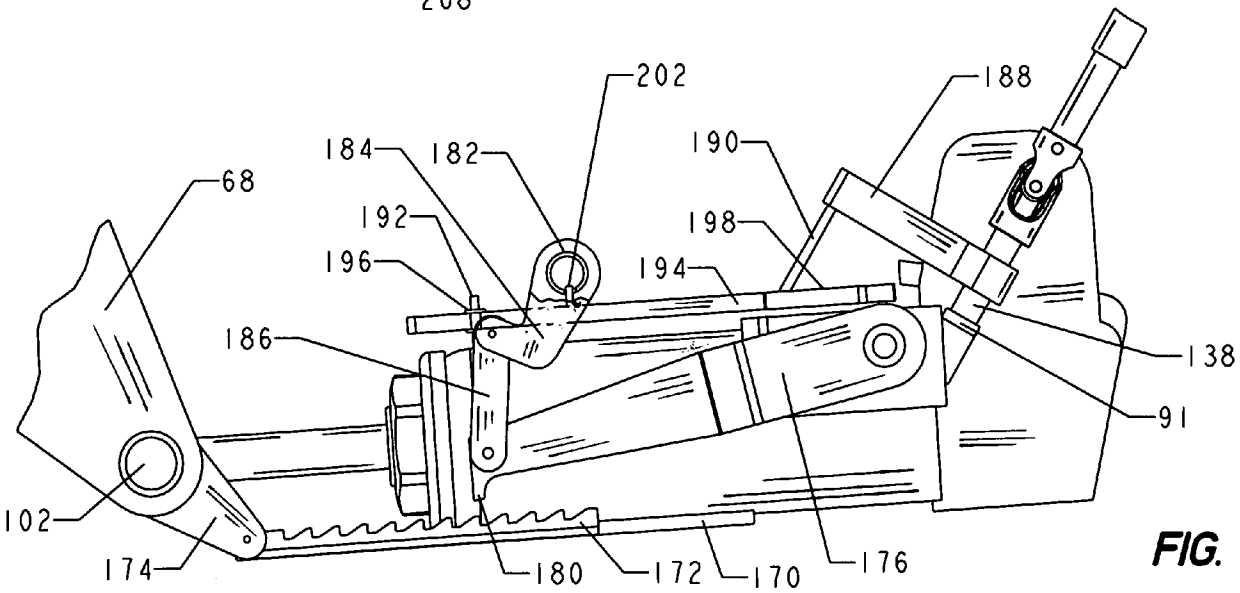
FIG. 6 is a left side elevational (partial sectional) view of the safety mechanism, as in FIG. 5, with the dogs disengaged from the rack bar.
Figure 7:
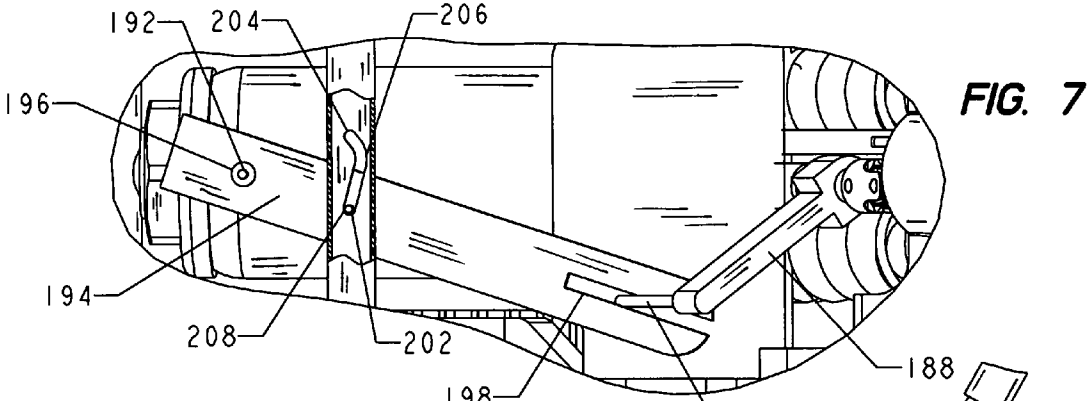
FIG. 7 is a partial top plan view of the safety mechanism, with the control valve in the fully open position.

The disengaging means further includes means for rotating the cam tube 182 by rotation of the control knob 132 to thereby raise and disengage the forward ends 180 of the dogs from the rack bars 172 (as shown in FIG. 6). Further rotation of the control knob releases the control valve 91 (as shown in FIG. 7).

The preferred cam tube rotating means includes the control shaft coupling 138 having a swing-arm 188 extending forwardly therefrom, with a swing arm-pin 190 extending generally perpendicularly and downwardly from the distal end thereof. A forward pivot pin 192 is attached to the frame and extends generally vertically at a position forward of the lateral cam tube 182 and near the longitudinal center of the frame. The forward pivot pin is shown attached and extending upward from the hydraulic cylinder (to better illustrate the surrounding components). The pivot pin is alternatively supported by and attached to a lateral rectangular bar attached to the side flanges of the frame, and the pivot pin is fixed in the position as illustrated.

Figure 5:
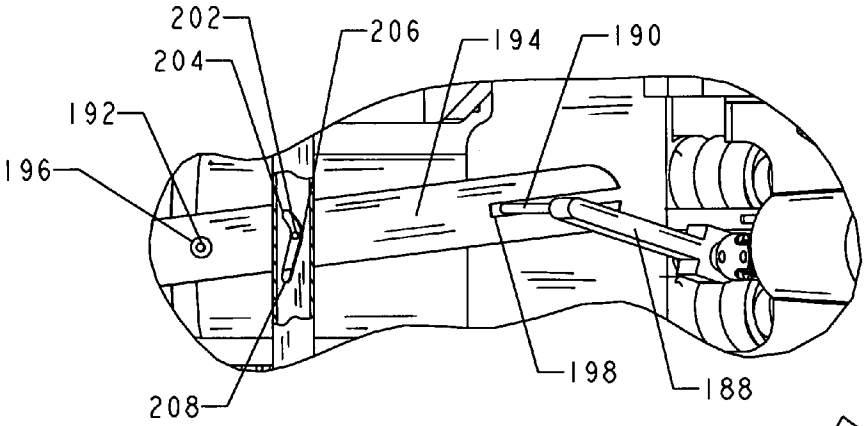
FIG. 5 is a partial top plan view of the safety mechanism, with the control valve rotated to disengage the dogs from the rack bars, with the control valve still in a closed position.

A swing-plate 194 is positioned generally horizontally and adjacently below the cam tube 182, and has a forward end 196 pivotally attached to the forward pivot pin 192, and has a slotted rearward end 198 pivotally and slideably engaged around the swing arm pin 190. Whereby, as the control knob 132 (and swing arm 188) is rotated, the swing-plate traverses laterally in an arc along the underside of the cam tube;

The cam tube 182 further has a generally "V" shaped slotted opening 200 in the cylindrical underside thereof. (The slotted opening is referenced as V shaped, but is more precisely that of a wide check-mark.) The swing plate 194 further has an upwardly extended cam follower stud 202 positioned and slideably engaged within the V slotted opening in the cam tube. The cam tube is shown in FIGS. 3, 5 and 7 with the upper surface partially cut away, and looking down at the V slotted opening in the underside of the tube. Whereby, as the control knob 132 (and swing arm 188) is rotated, the cam follower stud traverses within the V slotted opening, to thereby rotate the cam tube. The rotation of the cam tube raises and lowers the forward ends 180 of the dogs to and from engagement with the rack bars 172 to respectively lock and un-lock the lift arms 68.

Hydraulic cylinders specifications may vary somewhat but typically have a control valve with a quarter-turn (90°)

of rotation from fully closed to fully open. The hydraulic cylinder 89 typically remains closed from 0° to about 60° of counterclockwise rotation of the valve, then opens from about 60° to 90° of counterclockwise rotation. The position of the control knob 132 (and the swing arm 188) in FIGS. 3 and 4 correspond with the control valve fully closed and is referenced as 0°.

Referring particularly to FIGS. 5 and 6, the cam tube 182 and the V slotted opening 200 were developed so that a counterclockwise rotation of the control knob 132 (and swing arm 188) of about 30° would smoothly rotate the cam tube sufficiently to elevate the forward ends 180 of the dogs 176 from engagement with the rack bars 172. The elevation of the dogs at 30° of rotation of the control knob (prior to the valve opening at 60°) assure that the lift arms 68 are released prior to any opening of the release valve 91 that would actuate the safety mechanism. The cam tube retains the disengaged forward ends of the dogs while the control knob (and swing arm) is further rotated to the 60°-90° position to release the valve (see FIG. 7).

The V slotted opening 200 in the cam tube 182 has a right side 204 corresponding to the position of the cam follower stud 202 when the control valve 91 is in the fully closed position (as shown in FIG. 3). The opening is then angled in a direction laterally inwardly (corresponding to the position of the stud with a rotation of the valve of about 30°), and longitudinally (corresponding to a rotation of the cam tube sufficiently to elevate the forward ends of the dogs from engagement with the rack bars) from the right side to an apex 206 of the V slotted opening (as shown in FIG. 5). Then, from the apex, generally laterally inwardly in an arc corresponding to the radius from the pivot pin 192 to the cam-follower stud (and spiraled slightly upwardly, related to the shape of the cylindrical cam tube) to the left side 208 of the V slotted opening (as shown in FIG. 7).

Figure 8:
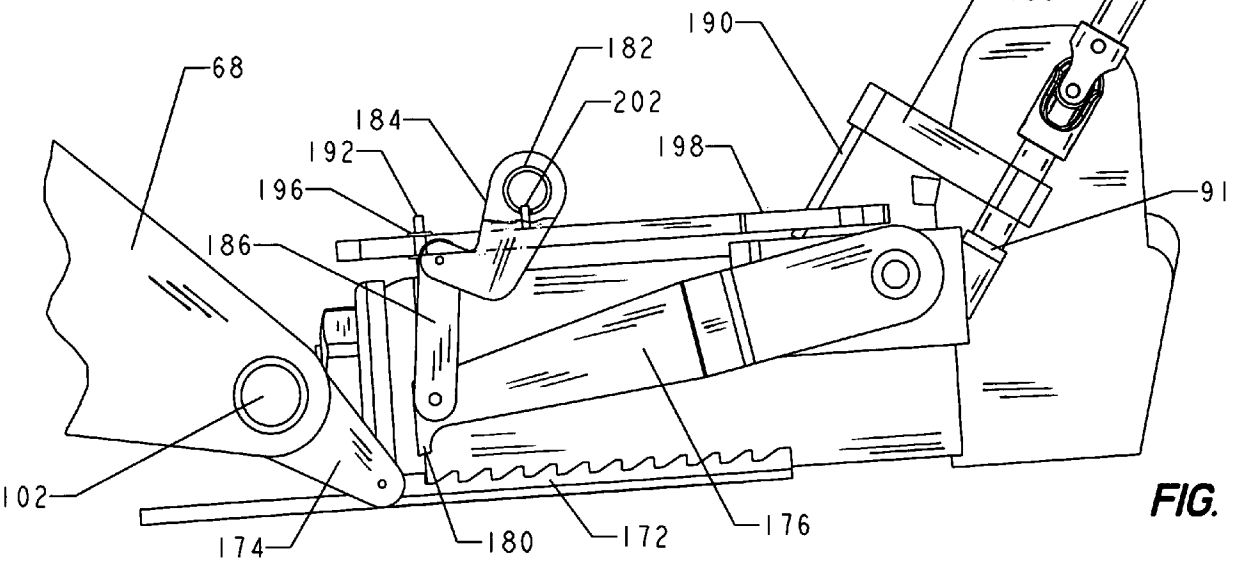
FIG. 8 is left side elevational (partial sectional) view of the safety mechanism, as in FIG. 7, with the control valve in the fully released position, dog released from the rack bar, and lift arms lowered.

Referring particularly to FIGS. 7 and 8, the safety mechanism is shown with the control knob 132 (and swing arm 188) in the 90 degree position. Whereby, the cam tube 182 retains the forward ends 180 of the dogs in the elevated position, while allowing the cam follower stud 202 to traverse laterally within the V slotted opening 200, to the left side 208 of the slotted opening as the control knob is further rotated to release the control valve.

Once the push bar 102 is released and the lift arms 68 of the power unit are lowered, the control knob is returned to the closed position, and the forward ends 180 of the dogs are again engaged with the rack bars 172.

As shown in FIGS. 4, 6 and 8, the lever arms 184 of the cam tube 182 extend downwardly and forwardly, and the apex 206 of the V slotted opening in the cam tube is oriented in the rearward direction. It is apparent that the lever arms can be configured to extend downwardly and rearwardly, with the apex of the V slotted opening oriented in the forward direction to rotate the cam tube in the opposite direction to elevate the lift arms. This is considered to be an equivalent design to the preferred embodiment.

As also shown in FIGS. 4, 6 and 8, the swing arm 188 is illustrated as extending perpendicularly from the coupling shaft 138. This clearly illustrates the concept of the "swing arm extending forwardly from the coupling". A variation of this configuration includes the swing arm extending forwardly at about 120° from the coupling shaft. This configuration provides a lower profile for the safety mechanism to better fit under the rear cover plate 98. This configuration also provides good vertical engagement of the swing arm pin 190 with the slotted rearward end 198 of the swing plate 194. This configuration is considered to be an equivalent embodiment of the present invention.

The engagement of the cam follower stud 202 in the V slotted opening 200 of the cam tube 182, and the engagement of the swing arm pin 190 in the slotted rearward end 198 of the swing plate 194 are shown and described as pins to show the rotation concept. These pins may further include roller bearings or bushings for durability and extended life of the safety mechanism.

The basic configuration of the preferred embodiment of the safety mechanism includes components that are rigid and sturdy and do not include delicate cables or springs. The components can be a variety of sizes and shapes to fit within the available space in the rear portion of a power unit, and still function based upon the concepts in the detailed description of the invention. The design does not require close tolerances and is inherently reliable and durable.

The configuration of the V slotted opening 200 is not precisely defined, but rather is described in angular and longitudinal terms to clearly describe the concept of the operation of the cam tube 182 and the cam follower stud 202 in relation to the rotation of the control knob. The actual configuration of the V slotted opening is dependent on the desired diameter and location of the cam tube, the lengths and angles of the lever arms 184, the location of the pivot pin 192, the length of the swing plate 194, etc. Once the forgoing component sizes and relationships have been generally established, the angles and dimensions of the V slotted opening can be readily determined utilizing computer aided design software, or otherwise by empirical experimentation, following the concept defined in the detailed description.

The preferred embodiments utilize pairs of guide rails 170, rack bars 172 and dogs 176, but a safety mechanism can be incorporated that utilizes only one of each of these components. Such an abbreviated design is considered to also fall with the scope of the present invention.

The control knob 132 is preferably biased in the closed position with a torsion spring. The control valve 91 is automatically closed and the dogs 176 are engaged with the rack bars 172. The dogs remain engaged throughout the lifting and supporting operation of the power unit. When it is desired to lower the power unit, the control knob is smoothly rotated in the counterclockwise direction; the initial 30° of rotation disengages the dogs and the continuing rotation of the control knob seamlessly releases the control valve at about the 60° position. The operator does not have to do anything other than operate the control knob of the power unit, and may be totally unaware of the safety mechanism operating under the rear cover plate of the power unit.

The present invention defines a safety mechanism that is continuously and automatically in position to lock the lift arms in the event of a power unit failure; and is further automatically releasable with the usual rotation of the control knob to lower the lift arms.

While specific embodiments and examples of the present invention have been illustrated and described herein, it is realized that modifications and changes will occur to those skilled in the art. It is therefore to be understood that the appended claims are intended to cover all such modifications and changes as may fall within the spirit and scope of the invention.

The invention claimed is:

1. A safety mechanism for a power unit, including a rectangular frame having a forward end, a rearward end, a bottom, sides, and a pair of longitudinal side flanges extending upward from the frame, with the rearward end having a tubular control handle pivotally attached and extending with a rotatable control knob at the upper end of the handle; a pivotal lifting system mounted on the frame including a pair of parallel lift arms having rearward ends interconnected by a lateral push bar and having forward ends rotatable upward for lifting a load; a pair of longitudinal U channel tracks attached to the inner side flanges within the frame and retaining the ends of the lateral push bar therein; a hydraulic cylinder, actuated by pumping the control handle, having an extendable ram for pushing the lateral push bar forward along the tracks for raising the forward ends of the lift arms, and a releasable control valve for retracting the ram for lowering the forward ends of the lift arms; the tubular handle enclosing a control shaft extending from the control knob to the rearward end of the frame and including a U-joint and coupling interconnecting the shaft to the control valve; the control knob is rotatable in the clockwise direction to close the control valve and is rotatable in the counterclockwise direction to release the control valve at about 60° to 90°; the power unit further including a rectangular bridge positioned on leveling pads and across the forward ends of the lift arms, whereby the power unit temporarily functions as a hydraulic floor jack; the safety mechanism comprising:

at least one guide rail, each fixed to the bottom of the rearward end of the frame and extending longitudinally therefrom;

at least one slidable rack bar, each having forward-ratcheting-teeth and a forward end pivotally linked to the push bar for traversing along said guide rail as the push bar is advanced and retracted;

at least one dog, each positioned and extended above said rack bar, each said dog having a rearward end pivotally attached to the frame, and having a forward end with a downward lug for engaging a respective tooth of said rack bar as said rack bar is advanced with the push bar; whereby in the event of any loss of hydraulic pressure, said dog is for retaining said rack bar from rearward movement; thereby safely locking the lift arms in the elevated position; and means for automatically disengaging the forward lug of said dog from said rack bar with rotation of the control knob.

2. The safety mechanism as defined in claim 1, further including a pair of said guide rails extending in parallel, a pair of said rack bars and a pair of said dogs.

3. The safety mechanism as defined in claim 2, wherein said disengaging means includes:

a lateral cam tube rotatably attached to the side flanges of the frame and positioned above the forward end of each said dog, and having at least one lever arm extending downwardly and near the forward end of each said dog;

at least one lifting link pivotally interconnecting the distal end of each lever arm of said cam tube to the forward end of each said dog; and means for rotating said cam tube to raise and disengage the forward end of each said dog from each said rack bar.

4. The safety mechanism as defined in claim 3, wherein said cam tube rotating means includes:

the control shaft coupling having a swing arm extending forwardly therefrom, with a swing arm pin extending generally perpendicularly and downwardly from the distal end thereof;

a forward pivot pin attached to the frame and extending generally vertically at a position forward of said cam tube and near the longitudinal center of the frame;

a swing plate positioned generally horizontally and adjacently below said cam tube, and having a forward end pivotally attached to said forward pivot pin, and having a slotted rearward end pivotally and slideably engaged around the swing arm pin of said swing arm; whereby, the swing plate is for pivoting, and traversing in a lateral arc along the underside of said cam tube as the control knob is rotated;

said cam tube further having a generally V shaped slotted opening in the cylindrical underside thereof; and said swing plate further having an upwardly extended cam follower stud positioned and slideably engaged within the V slotted opening of said cam tube, whereby, the cam follower stud is for traversing within the V slotted opening for rotating said cam tube as the control knob is rotated, for thereby raising and lowering the forward ends of said dogs to and from engagement with said rack bars.

5. The safety mechanism as defined in claim 4, wherein the V slotted opening in said cam tube has a right side corresponding to the position of the cam follower stud when the control valve is in the fully closed position; the opening is then angled in a direction laterally inwardly therefrom, corresponding to the position of the stud with a rotation of the control valve that does not open the valve, and longitudinally therefrom, corresponding to a rotation of said cam tube sufficiently to elevate the forward ends of said dogs from engagement with said rack bars, to an apex of the V slotted opening; and from the apex, laterally inwardly in an arc corresponding to the radius from said pivot pin to the cam-follower stud to the left side of the V slotted opening corresponding to the position of the cam follower stud when the control valve is in the fully open position.

6. The safety mechanism as defined in claim 5, wherein the V slotted opening in said cam tube extends from the right side thereof, angled in a direction laterally inwardly corresponding to the position of said cam follower stud with a rotation of the control valve of about 30°.

7. The safety mechanism as defined in claim 6, wherein the lever arms of said cam tube extend downwardly and forwardly, and the apex of the V slotted opening in the underside of said cam tube is in the rearward direction.

8. The safety mechanism as defined in claim 6, wherein the lever arms of said cam tube extend downwardly and rearwardly, and the apex of the V slotted opening in the underside of said cam tube is in the forward direction.

9. A safety mechanism for a power unit, including a rectangular frame having a forward end, a rearward end, a bottom sides, and a pair of longitudinal side flanges extending upward from the frame, with the rearward end having a tubular control handle pivotally attached and extending with a rotatable control knob at the upper end of the handle; a pivotal lifting system mounted on the frame including a pair of parallel lift arms having rearward ends interconnected by a lateral push bar and having forward ends rotatable upward for lifting a load; a pair of longitudinal U channel tracks attached to the inner side flanges within the frame and retaining the ends of the lateral push bar therein; a hydraulic cylinder, actuated by pumping the control handle, having an extendable ram for pushing the lateral push bar forward along the tracks for raising the forward ends of the lift arms, and a releasable control valve for retracting the ram for lowering the forward ends of the lift arms; the tubular handle enclosing a control shaft extending from the control knob to the rearward end of the frame and including a U-joint and coupling interconnecting the shaft to the releasable control valve; the control valve being fully closed from 0 to about 60° of counterclockwise rotation, then releasable from about 60° to 90°; and the power unit further including a rectangular bridge positioned on leveling pads and across the forward ends of the lift arms, whereby the power unit temporarily functions as a hydraulic floor jack; the safety mechanism comprising:

a pair of parallel guide rails fixed to the bottom of the rearward end of the frame and extending longitudinally to a distance corresponding to that of the fully extended push bar;

a pair of slidable rack bars each having forward-ratcheting-teeth and a forward end pivotally linked to the push bar for traversing along said guide rails as the push bar is advanced and retracted;

a pair of dogs positioned and extended above said rack bars, each having a rearward end pivotally attached to the frame, and having a forward end with a downward lug for engaging a respective tooth of said rack bar, as said rack bar is advanced with the push bar, a lateral cam tube rotatably attached to the side flanges of the frame and positioned above the forward ends of said dogs, having a generally V shaped slotted opening in the cylindrical underside thereof; and having a pair of lever arms extending downwardly and forwardly near the forward ends of said dogs;

a pair of lifting links pivotally interconnecting the distal ends of the lever arms of said cam tube to the forward ends of said dogs;

the control shaft coupling having a swing arm extending forwardly therefrom, with a swing arm pin extending generally perpendicularly and downwardly from the distal end thereof;

a forward pivot pin attached to the frame and extending generally vertically at a position forward of said cam tube and near the longitudinal center of the frame;

a swing plate positioned generally horizontally and adjacently below said cam tube, and having a forward end pivotally attached to said forward pivot pin, and having a slotted rearward end pivotally and slideably engaged around the swing-arm pin of said swing arm; said swing plate further having an upwardly extended cam-follower stud positioned and slideably engaged within the V slotted opening of said cam tube; and the V slotted opening in said cam tube having a right side corresponding to the position of the cam follower stud when the control valve is in the fully closed position; the opening is then angled in a direction from the right side thereof, laterally inwardly corresponding to the position of the stud with a rotation of the control valve of about 30°, and longitudinally from the right side thereof, corresponding to a rotation of the tube sufficiently to elevate the forward ends of said dogs from engagement with said rack bars, to an apex of the V slotted opening; and from the apex, further laterally inwardly in an arc corresponding to the radius from said pivot pin to the cam-follower stud, to the left side of the V slotted opening, corresponding to the position of the cam follower stud when the control valve is in the fully open position.

* * * * *